US007338255B2

(12) United States Patent
Nabesaka et al.

(10) Patent No.: US 7,338,255 B2
(45) Date of Patent: Mar. 4, 2008

(54) TURBO-TYPE FLUID MACHINE AND A STEPPED SEAL APPARATUS TO BE USED THEREIN

(75) Inventors: Shusaku Nabesaka, Tokyo (JP); Sadashi Tanaka, Tokyo (JP); Shinsuke Sakurai, Tokyo (JP)

(73) Assignee: Hitachi Industries Co., Ltd., Tokyo (JP)

( * ) Notice: Subject to any disclaimer, the term of this patent is extended or adjusted under 35 U.S.C. 154(b) by 405 days.

(21) Appl. No.: 11/174,501

(22) Filed: Jul. 6, 2005

(65) Prior Publication Data

US 2006/0008348 A1 Jan. 12, 2006

(30) Foreign Application Priority Data

Jul. 7, 2004 (JP) ..... 2004-200002

(51) Int. Cl.
*F01D 5/00* (2006.01)

(52) U.S. Cl. ..... 415/173.6; 415/171.1; 415/174.4; 415/174.5

(58) Field of Classification Search ..... 415/171.1, 415/173.6, 174.4, 174.5; 277/308, 418
See application file for complete search history.

(56) References Cited

U.S. PATENT DOCUMENTS 1,020,699 A * 3/1912 Kieser ..... 415/172.1
3,231,285 A * 1/1966 Weltmer et al. ..... 277/418
3,516,757 A * 6/1970 Baumann ..... 415/174.1
4,286,919 A * 9/1981 Yamaguchi ..... 415/174.5
5,639,095 A * 6/1997 Rhode ..... 277/303

FOREIGN PATENT DOCUMENTS

JP A-11-343996 12/1999

* cited by examiner

*Primary Examiner*—Igor Kershteyn
(74) *Attorney, Agent, or Firm*—Crowell & Moring LLP

(57) ABSTRACT

A turbo-type fluid machine comprises a mouth ring part provided between a shroud of an impeller and a pump casing and having a seal function. The mouth ring part comprises an impeller ring on a side of the shroud of the impeller and a casing ring provided on a side of a non-rotating body wall surface of the casing. The impeller ring is structured to have a stepped portion that is in the form of a staircase with at least two steps to be small in diameter toward a suction side of the impeller and large in diameter toward an outlet of the impeller. The casing ring is labyrinth-shaped to comprise a projection and a recess. A narrow clearance part having a narrow radial clearance is formed between the projection and the impeller ring. A flow passage spatial portion defining an enlarged portion of the narrow radial clearance is formed by the recess and the stepped portion of the impeller ring.

9 Claims, 4 Drawing Sheets

TURBO-TYPE FLUID MACHINE AND A STEPPED SEAL APPARATUS TO BE USED THEREIN

BACKGROUND OF THE INVENTION

The present invention relates to a turbo-type fluid machine provided with a mouth ring that seals a narrow rotation clearance between a non-rotating body such as a pump casing, etc. and an impeller shroud, and a stepped seal apparatus to be used for the mouth ring in the turbo-type fluid machine.

Turbo-type fluid machines comprise a rotating shaft and an impeller mounted to the rotating shaft, and work is done by that difference in angular momentum between an inlet and an outlet of the impeller, which is generated by the impeller being rotated by the rotating shaft. Therefore, except the case of a full open impeller, a narrow rotation clearance or clearances are formed in one or two locations between a non-rotating body and an impeller. A loss is caused by that leakage flow, which flows from a high-pressure side to a low-pressure side in the impeller through the narrow clearance or clearances. Such leakage loss amounts in some cases to 20% as large as a total loss in the case where a fluid machine of high efficiency runs at a low specific speed.

The leakage flow q is in proportion to a cross sectional area A of a narrow clearance and the square root of a differential pressure ΔP between the front and the rear of the narrow clearance and in inverse proportion to the square root of flow resistance ζ in the narrow clearance. Therefore, various considerations are taken to increase the flow resistance in the narrow clearance.

$$q=\alpha A\sqrt{\Delta P/\zeta} \quad (1)$$

where α is a constant.

The flow resistance ζ in the narrow clearance is classified into two kinds, that is, frictional loss generated at the time of flowing through the narrow clearance, and suddenly enlarged loss and suddenly contracted loss, which are attendant on changes of the narrow clearance in shape and cross sectional area. Since the frictional loss is determined by dimensions of the narrow clearance, the velocity of flow of a working fluid, and a coefficient of kinematic viscosity, there are limits in making a clearance extremely narrow and in lengthening the clearance to cause an increase in resistance from the necessity of avoiding contact between an impeller and a non-rotating body. Therefore, a seal apparatus for reduction in leakage loss in a mouth ring part is in most cases structured to effectively introduce changes in shape and cross sectional area, and uses, for example, a staircase-shaped labyrinth seal construction described in JP-A-11-343996.

Since a labyrinth seal construction in a conventional mouth ring part makes use of that adiabatic compression effect, which is produced by sudden area enlargement from a projection of a labyrinth to a recess thereof, for flow resistance, however, no sufficient effect for reduction of leakage flow is obtained in the case where the construction is used for a turbo-type fluid machine such as a pump, etc., in which an incompressible fluid is treated, as it is.

In a turbo-type fluid machine such as a pump, etc., in which an incompressible fluid is treated, it is conceivable to provide a labyrinth construction composed of recesses and projections on a side of an impeller shroud as shown in FIG. 6 to make use of an effect of a secondary flow on the incompressible fluid produced by centrifugal forces generated in the labyrinth to increase the flow resistance. However, this construction involves a problem that an amount of leakage is considerably increased when relative axial positions of a rotating body and a stationary body change. Also, with the construction shown in FIG. 6, projections 4*b* are smaller in axial dimension than recesses 4*a* in a impeller ring 4 that constitutes a labyrinth part, by which working is made difficult and working with high precision is also demanded.

Therefore, in a turbo-type fluid machine such as a pump, etc., in which an incompressible fluid is treated, it is conceivable to use a stepped seal apparatus of a multi-stage construction, in which a narrow clearance part is larger in axial length than a clearance part as shown in FIG. 7. In case of using such stepped seal apparatus of a multi-stage construction, however, a ratio of leakage loss in a stepped seal part to a total loss amounts to a magnitude that cannot be disregarded, as described above, and becomes a serious problem in a competition of efficiency at 1% level in the present market.

BRIEF SUMMARY OF THE INVENTION

It is an object of the invention to provide a turbo-type fluid machine capable of sufficiently reducing leakage flow from a mouth ring part in that turbo-type fluid machine, such as a pump, etc., in which an incompressible fluid is treated, and being easy to manufacture and high in reliability, and a stepped seal apparatus to be used therefor.

In order to attain the object, the invention provides a turbo-type fluid machine comprising a rotating shaft arranged in a pump casing, an impeller mounted on the rotating shaft, and a mouth ring part provided between a shroud of the impeller and the pump casing and having a seal function, and wherein the mouth ring part comprises an impeller ring on a side of the shroud of the impeller and a casing ring provided on a side of a non-rotating body wall surface of the casing, the impeller ring is structured to have a stepped portion that is in the form of a staircase with at least two steps to be small in diameter toward a suction side of the impeller and large in diameter toward an outlet of the impeller, and the casing ring is labyrinth-shaped to have a projection and a recess, a narrow clearance part having a narrow radial clearance is formed between the projection and the impeller ring, and a flow passage spatial portion defining an enlarged portion of the narrow radial clearance is formed by the recess and the stepped portion of the impeller ring.

It is preferable that axial positions of a radial wall portion of the stepped portion of the impeller ring and a radial wall portion of the labyrinth-shaped recess on the side of the non-rotating body are caused to coincide with or substantially with each other.

It is preferable that the flow passage spatial portion formed by the stepped portion of the impeller ring and the labyrinth-shaped recess on the side of the non-rotating body is made substantially rectangular-shaped, and a radial position of the narrow clearance part with the narrow radial clearance is radially outward from a radially central position of the flow passage spatial portion, which is formed by the stepped portion and the labyrinth-shaped recess and provided downstream of the narrow clearance part. In particular, it is preferable that a radial position of the narrow clearance part is radially outward from a bottom surface of the flow passage spatial portion, which is formed by the stepped portion and the labyrinth-shaped recess, to be in the range of a height of ½ to ¾ as high as the flow passage spatial portion.

A further feature of the invention resides in a turbo-type fluid machine comprising a rotating shaft arranged in a casing, an impeller mounted on the rotating shaft, and a mouth ring part provided between a shroud of the impeller and the casing and having a seal function, and wherein the mouth ring part comprises an impeller ring on a side of the shroud of the impeller and a casing ring provided on a side of a non-rotating body wall surface of the casing, the impeller ring is structured to have a stepped portion with at least three steps to be small in diameter toward a suction side of the impeller and large in diameter toward an outlet of the impeller, and the casing ring includes a labyrinth-shaped projection and a labyrinth-shaped recess, a narrow clearance part is formed between the labyrinth-shaped projection and the impeller ring, a flow passage spatial portion defining an enlarged portion of a radial clearance is formed by the labyrinth-shaped recess and the stepped portion of the impeller ring, and a secondary flow (D) directed radially outwardly of the narrow clearance part from radially inwardly of the narrow clearance part is generated in the flow passage spatial portion.

A still further feature of the invention resides in a stepped seal apparatus comprising a narrow staircase-shaped clearance formed between a rotating body and a stationary body of a turbo-type fluid machine to provide for sealing therebetween, and wherein a seal surface on a side of the rotating body is structured to be small in diameter on a low-pressure side (suction side) and large in diameter on a high-pressure side (discharge side) and to comprise a stepped portion of at least three stages, and a seal surface of the stationary body is structured to include a labyrinth-shaped projection and a labyrinth-shaped recess, a narrow clearance part is formed between the labyrinth-shaped projection and the seal surface on the side of the rotating body, a flow passage spatial portion defining an enlarged portion of a radial clearance is formed by the labyrinth-shaped recess and the stepped portion of the seal surface on the side of the rotating body, and a secondary flow (D) directed radially outwardly of the narrow clearance part from radially inwardly of the narrow clearance part is generated in the flow passage spatial portion.

In the above construction, it is preferable that a material of a member that defines the seal surface on the side of the stationary body is a thermoplastic resin. Also, leakage flow can be reduced further by forming a plurality of shallower labyrinth grooves than a depth of the labyrinth-shaped recess on an inner wall surface of the projection of the casing ring that defines the narrow clearance part.

According to the invention, even with a turbo-type fluid machine, in which an incompressible fluid is treated, it is possible to increase the flow resistance of a fluid flowing in a stepped portion provided on the stepped seal apparatus to reduce leakage flow from the stepped seal apparatus.

Since the labyrinth-shaped projection can be increased in axial dimension relative to the labyrinth-shaped recess, high-precision working is made easy, so that it is possible to obtain a turbo-type fluid machine easy to manufacture, and a stepped seal apparatus to be used therefor.

Further, since a substantially swirling flow can be inhibited from generating in the flow passage spatial portion formed on the stepped portion of the stepped seal apparatus, leakage loss can be decreased, without losing reliability, even in use for a pump, which treats a liquid containing slurry.

When a material of the non-rotating body side seal part is a thermoplastic resin, generation of seizure can be prevented since the thermoplastic resin is low in friction, excellent in abrasion-resistant property, and self-lubricating. As a result, a clearance on the seal part can be further decreased to reduce an amount of leakage further, so that it is possible to exhibit the effect of the invention to the maximum.

Other objects, features and advantages of the invention will become apparent from the following description of the embodiments of the invention taken in conjunction with the accompanying drawings.

DETAILED DESCRIPTION OF THE INVENTION

Embodiments of the invention, in which leakage flow from a mouth ring part in a turbo-type fluid machine, in which an incompressible fluid is treated, can be sufficiently reduced, and which is easy to manufacture, will be described hereinafter with reference to the drawings.

Figure 1:
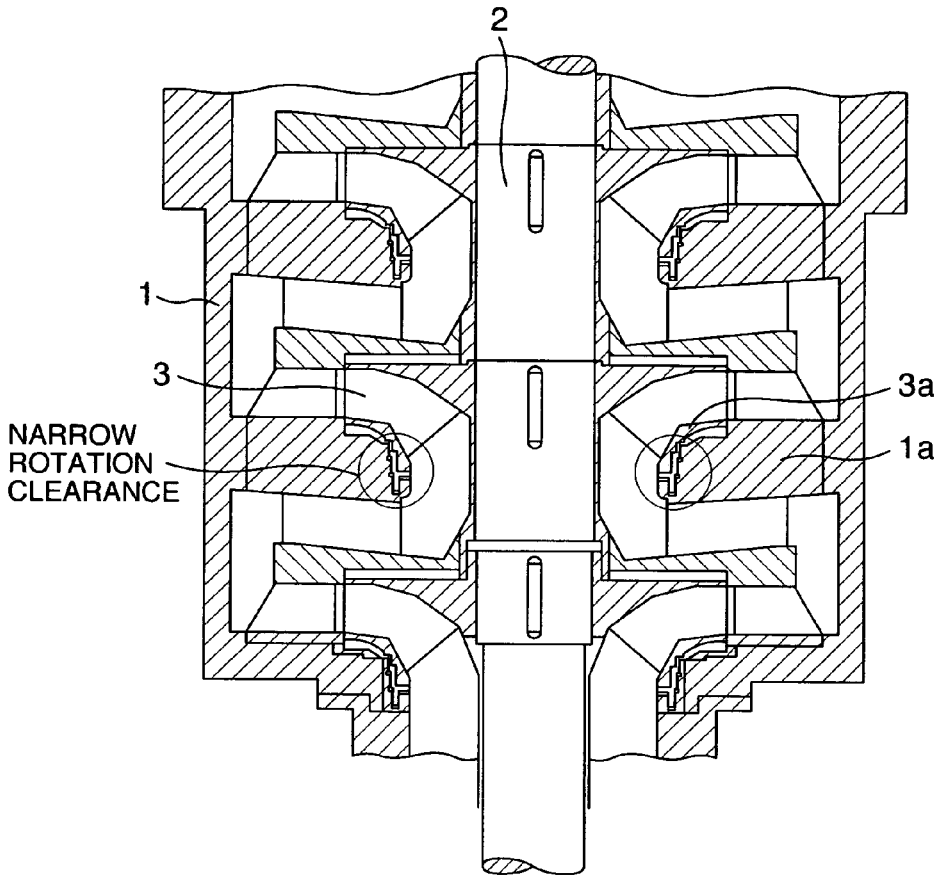
FIG. 1 is a longitudinal sectional view showing an essential part of a turbo-type fluid machine (centrifugal pump) according to an embodiment of the invention.
Figure 3:
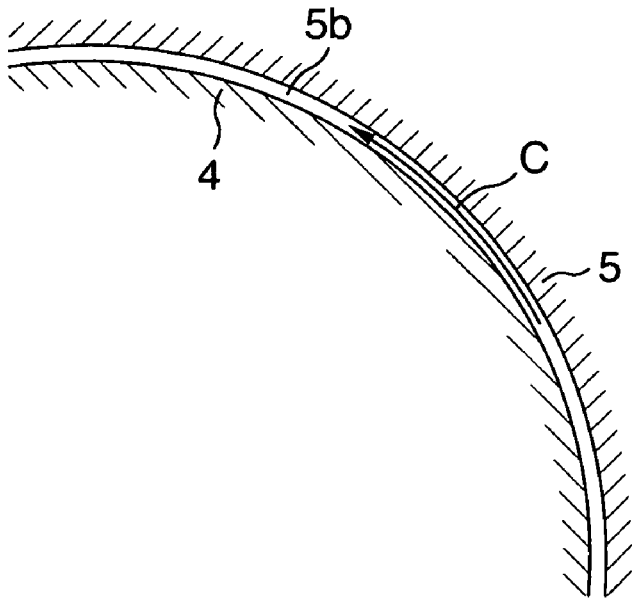
FIG. 3 is a cross sectional view showing a configuration of a neighborhood of a labyrinth-shaped recess shown in FIG. 2.
Figure 4:
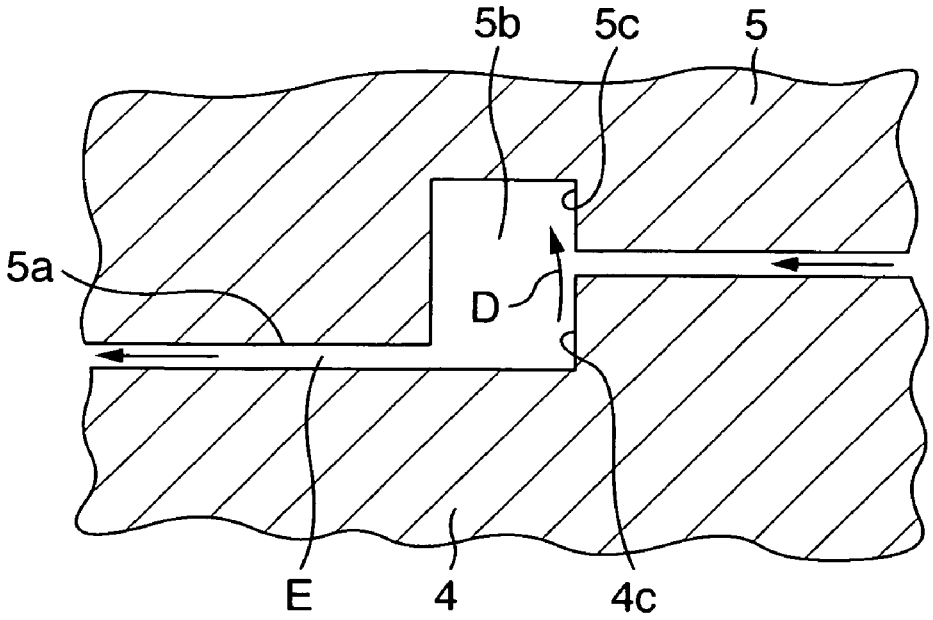
FIG. 4 is a cross sectional view showing, in detail, a construction of an essential part of a stepped seal apparatus in the mouth ring part shown in FIG. 2.

An embodiment of the invention will be described with reference to FIGS. 1 to 4. FIG. 1 is a longitudinal sectional view showing an essential part of a turbo-type fluid machine (centrifugal pump) according to the embodiment, FIG. 2 is a cross sectional view showing a detailed structure of a mouth ring part in the centrifugal pump shown in FIG. 1, FIG. 3 is a cross sectional view showing a configuration of a neighborhood of a labyrinth-shaped recess 5*b* shown in FIG. 2, and FIG. 4 is a cross sectional view showing, in detail, a construction of an essential part of a stepped seal apparatus in the mouth ring part.

As shown in FIG. 1, a turbo-type fluid machine (centrifugal pump) in the embodiment comprises a rotating shaft 2 arranged in a casing 1 and driven by a driving machine (not shown), and a plurality of impellers 3 arranged to be fitted onto the rotating shaft 2 in multi-stages. Since a narrow rotation clearance part is defined between the casing 1 and the impeller 3 being a rotating body, a impeller ring 4 (see FIG. 2) is provided on a side of an impeller shroud 3*a* and a casing ring 5 (see FIG. 2) is also provided on a non-rotating body wall surface 1*a* of the casing 1 in opposition to the impeller shroud in order to inhibit leakage flow of a working fluid through the narrow rotation clearance part from an impeller outlet side to an impeller suction side.

Figure 2:
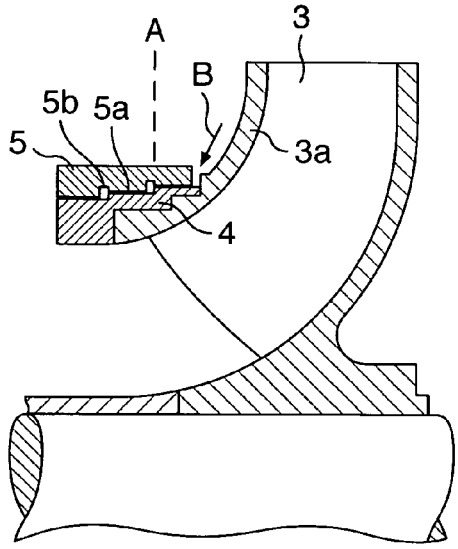
FIG. 2 is a cross sectional view showing a detailed structure of a mouth ring part in the centrifugal pump shown in FIG. 1.

As shown in FIG. 2, according to the embodiment, a stepped seal apparatus is formed on the impeller and casing rings 4, 5. The impeller ring 4 is made small in diameter on the impeller suction side and large in diameter on the impeller outlet side and staircase-shaped with two or more steps (three steps in the embodiment). The casing ring 5 is labyrinth-shaped and structured such that, for each step, a stepped portion (radially extending wall portion) 4*c* (see FIG. 4) on the impeller ring 4 and a radially extending wall portion 5*c* (see FIG. 4) of the labyrinth-shaped recess 5*b* on the casing ring 5 coincide with each other in an axial position A (an end position downstream of leakage flow through a radial narrow clearance part).

Since the centrifugal pump according to the embodiment is constructed in a manner described above, a combination of that portion, in which a radial clearance serving as a passage of leakage flow is suddenly enlarged in area, and that portion, in which the radial clearance is suddenly decreased, can be provided by a double cylinder portion, in which a narrow radial clearance part E is defined by a labyrinth-shaped projection 5*a* and the impeller ring 4, and an enlarged portion of that radial clearance, which is defined by the labyrinth-shaped recess 5*b* and a stepped portion of the impeller ring 4. Also, the double cylinder portions on respective steps (stepped portions) of the stepped seal apparatus can be radially positionally shifted relative to one another. As a result, a fluid does not flow, as a jet flow, into the flow passage spatial portion (recess) 5*b* from the labyrinth-shaped projection (tooth portion) 5*a* without being compressed, to thereby flow short-circuiting the flow passage spatial portion 5*b*, unlike the case where a conventional labyrinth seal is applied to an incompressible fluid, and therefore, it is possible to. effectively increase the flow resistance in the narrow rotation clearance part to reduce the leakage flow.

The stepped portion (recess) 5*b* of the casing ring 5 is labyrinth-shaped and structured to be enlarged radially outwardly of the clearance part (the radial clearance part E). Therefore, as shown in FIG. 4, a centrifugal force produces an effect on a fluid in the vicinity of the vertical wall surface 4*c* on a side of the impeller shroud 3*a* to generate a secondary flow D directed radially outward, and the secondary flow D acts effectively, so that the suddenly enlarged region is increased in resistance to enable greatly enhancing a sealing effect as compared with stepped seal apparatuses as shown in FIGS. 6 and 7.

Figure 6:
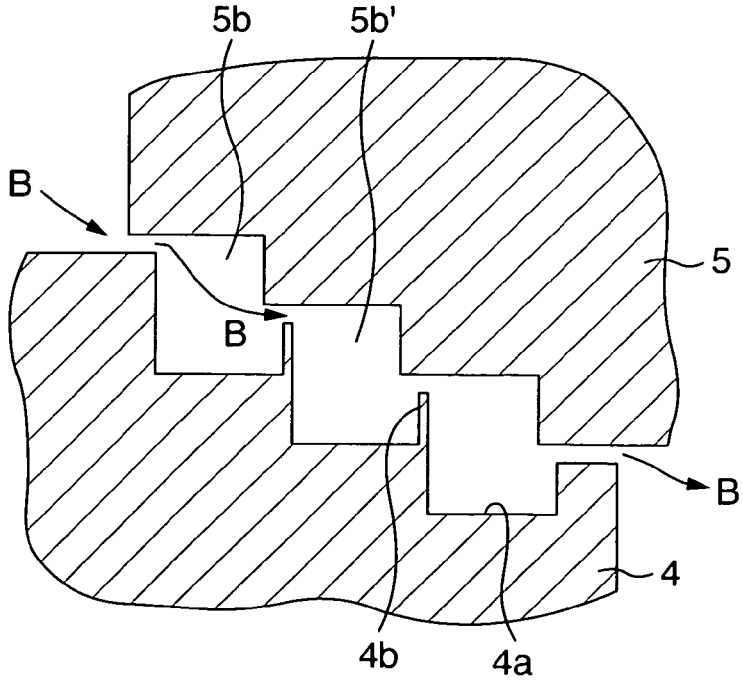
FIG.6 PRIOR ART
FIG. 6 is a cross sectional view showing an example of a conventional stepped seal apparatus.
Figure 7:
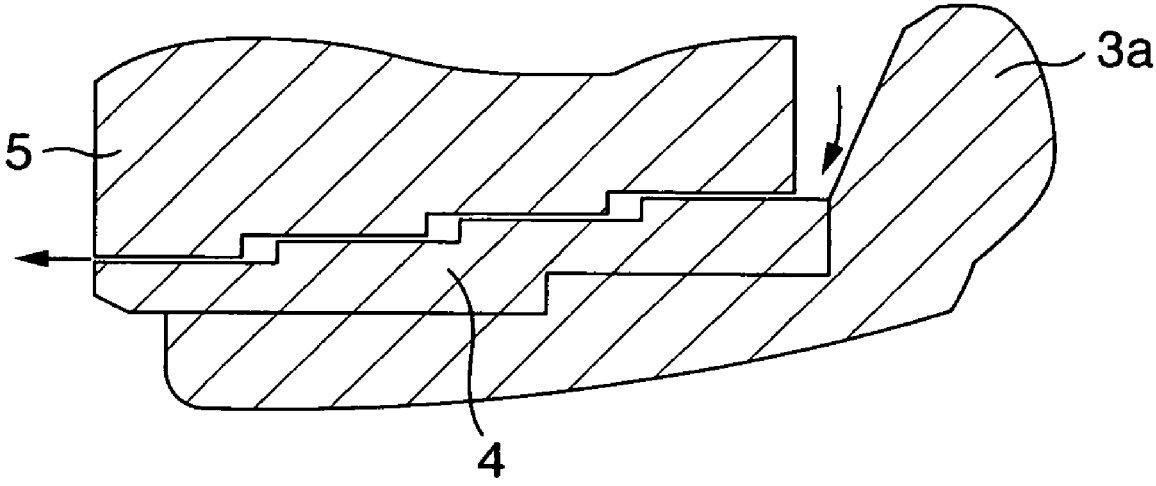
FIG.7 PRIOR ART
FIG. 7 is a cross sectional view showing another example of a conventional stepped seal apparatus.

Further, as compared with the stepped seal apparatuses as shown in FIGS. 6 and 7, there is produced an effect that the flow passage spatial portion in the labyrinth-shaped recess 5*b* can be increased in volume and the secondary flow D brings about an increase in interference action whereby a swirling flow C (see FIG. 3) in the flow passage spatial portion (recess 5*b*) can also be decreased to cause a resistance when a swirling flow is again formed in a narrow clearance part (the narrow radial clearance part E downstream of leakage flow) on a succeeding step with the result that the stepped seal apparatus can be increased in outflow/inflow resistance and so an amount of leakage can be considerably reduced.

Second Embodiment

Figure 5:
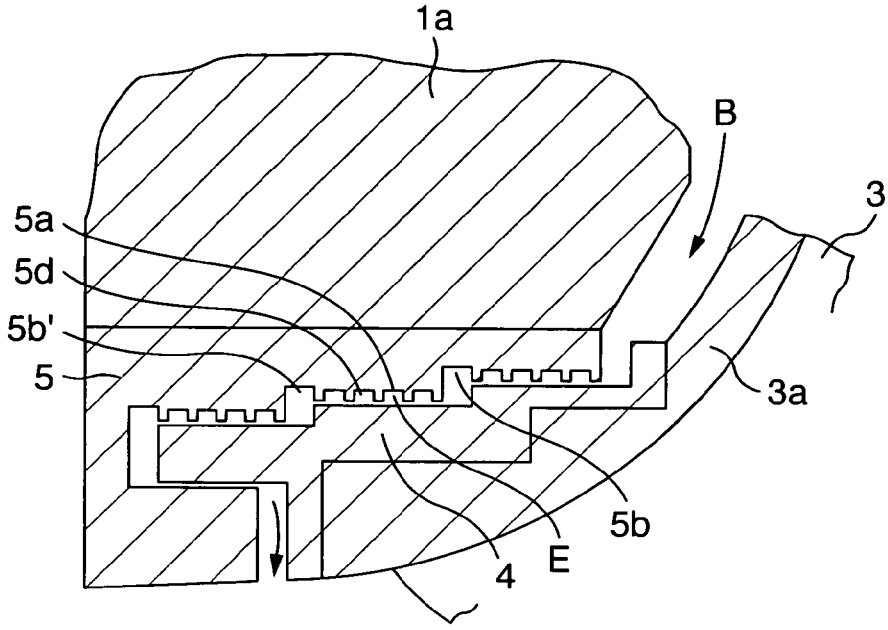
FIG. 5 is a cross sectional view showing, in detail, a stepped seal apparatus according to a further embodiment of the invention.

FIG. 5 is a cross sectional view showing, in detail, a stepped seal apparatus according to a further embodiment of the invention and showing a further example of a stepped seal apparatus provided on a mouth ring part. The embodiment has the same construction as that of the preceding embodiment in that a flow passage spatial portion defined by a stepped portion on an impeller ring 4 and a labyrinth-shaped recess 5*b* on a side of a non-rotating body is made substantially rectangular-shaped and the labyrinth-shaped recess 5*b* of a casing ring 5 in the flow passage spatial portion is enlarged radially outwardly of a narrow clearance part (radial clearance part) E. The embodiment is also configured such that shallower labyrinth grooves 5*d* than the recess 5*b* are provided on an inner wall surface of the casing ring 5 to be arranged in the narrow clearance part E.

Since the embodiment is constructed in a manner described above, it is possible to inhibit leakage flow B from short-circuiting and flowing to a succeeding labyrinth-shaped recess 5*b'* from the labyrinth-shaped recess 5*b* upstream thereof to effectively increase the flow resistance in the narrow clearance part E to reduce the leakage flow. In particular, when the narrow clearance part E is positioned radially in the range of ½ to ¾ (a position of ½ to ¾ as high as the height of the flow passage spatial portion radially outwardly from a bottom of the flow passage spatial portion) as high as the height of the flow passage spatial portion defined by the stepped portion of the impeller and the non-rotating body side labyrinth-shaped recess 5*b*, 5*b'*, a secondary flow acts effectively, so that a substantially swirling flow C flowing circumferentially in the labyrinth-shaped recess is not formed. As a result, in case of treating a slurry water containing a silt component, it is possible to prevent abrasion of the narrow clearance part due to circulation of the silt component and also in a high-pressure pump, it is possible to reduce a danger of generation of erosion on an outlet side wall surface of the stepped portion due to leakage flow B at high velocity. Further, the labyrinth grooves 5*d* is formed on a casing side wall surface of the narrow clearance part E whereby it is also possible to further decrease an amount of leakage flow, slide torque, and swirling flow.

It is desired that a material of the casing ring 5 constituting the stepped seal apparatus be a thermoplastic resin. Thermoplastic resins are favorable in heat transfer characteristics to enable formation of a narrow rotation clearance part having a narrow clearance dimension, and makes it easy to remove heat caused by sliding even if a mouth ring causes contact or a foreign matter is bitten. Accordingly, it is possible to achieve an improvement in seal performance to realize a multi-stage configuration without changing an axial length of an impeller, thus enabling exhibiting the performance of a stepped seal apparatus to the maximum.

As described in detail above, the embodiment produces an effect that even in the case where a working fluid is incompressible, a seal apparatus on a mouth ring part can be increased in flow resistance and even in case of a liquid containing slurry, leakage loss can be decreased without losing reliability since a substantially swirling flow flowing circumferentially in a labyrinth-shaped recess is not formed.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A turbo-type fluid machine comprising a rotating shaft arranged in a pump casing, an impeller mounted on the rotating shaft, and a mouth ring part provided between a shroud of the impeller and the pump casing and having a seal function, and wherein the mouth ring part comprises an impeller ring on a side of the shroud of the impeller and a casing ring provided on a side of a non-rotating body wall surface of the casing, the impeller ring is structured to have a stepped portion that is in the form of a staircase with at least two steps to be small in diameter toward a suction side of the impeller and large in diameter toward an outlet of the impeller, and the casing ring is labyrinth-shaped to have a projection and a recess, a narrow clearance part having a narrow radial clearance is formed between the projection and the impeller ring, and a flow passage spatial portion defining an enlarged portion of the narrow radial clearance is formed by the recess and the stepped portion of the impeller ring.

2. A turbo-type fluid machine according to claim 1, wherein axial positions of a radial wall portion of the stepped portion of the impeller ring and a radial wall portion of the labyrinth-shaped recess on the side of the non-rotating body coincide with or substantially coincide with each other.

3. A turbo-type fluid machine according to claim 1, wherein the flow passage spatial portion formed by the stepped portion of the impeller ring and the labyrinth-shaped recess on the side of the non-rotating body is made substantially rectangular-shaped, and a radial position of the narrow clearance part with the narrow radial clearance is radially outward from a radially central position of the flow passage spatial portion, which is formed by the stepped portion and the labyrinth-shaped recess and provided downstream of the narrow clearance part.

4. A turbo-type fluid machine according to claim 3, wherein a radial position of the narrow clearance part is radially outward from a bottom surface of the flow passage spatial portion, which is formed by the stepped portion and the labyrinth-shaped recess, to be in the range of a height of ½ to ¾ as high as the flow passage spatial portion.

5. A turbo-type fluid machine comprising a rotating shaft arranged in a casing, an impeller mounted on the rotating shaft, and a mouth ring part provided between a shroud of the impeller and the casing and having a seal function, and wherein the mouth ring part comprises an impeller ring on a side of the shroud of the impeller and a casing ring provided on a side of a non-rotating body wall surface of the casing, the impeller ring is structured to have a stepped portion with at least three steps to be small in diameter toward a suction side of the impeller and large in diameter toward an outlet of the impeller, and the casing ring includes a labyrinth-shaped projection and a labyrinth-shaped recess, a narrow clearance part is formed between the labyrinth-shaped projection and the impeller ring, a flow passage spatial portion defining an enlarged portion of a radial clearance is formed by the labyrinth-shaped recess and the stepped portion of the impeller ring, so that a secondary flow (D) directed radially outwardly of the narrow clearance part from radially inwardly of the narrow clearance part is generated.

6. A turbo-type fluid machine according to claim 1, wherein a material of the casing ring is a thermoplastic resin.

7. A turbo-type fluid machine according to claim 1, wherein a plurality of shallower labyrinth grooves than a depth of the recess are formed on an inner wall surface of the projection of the casing ring that defines the narrow clearance part.

8. A stepped seal apparatus comprising a narrow staircase-shaped clearance formed between a rotating body and a stationary body of a turbo-type fluid machine to provide for sealing therebetween, and wherein a seal surface on a side of the rotating body is structured to be small in diameter on a suction side and large in diameter on a discharge side and to comprise a stepped portion of at least three stages, and a seal surface of the stationary body is structured to include a labyrinth-shaped projection and a labyrinth-shaped recess, a narrow clearance part is formed between the labyrinth-shaped projection and the seal surface on the side of the rotating body, a flow passage spatial portion defining an enlarged portion of a radial clearance is formed by the labyrinth-shaped recess and the stepped portion of the seal surface on the side of the rotating body so that and a secondary flow directed radially outwardly of the narrow clearance part from radially inwardly of the narrow clearance part is generated in the flow passage spatial portion.

9. A turbo-type fluid machine according to claim 8, wherein a material of a member that defines the seal surface on the side of the stationary body is a thermoplastic resin, and a radial position of the narrow clearance part is radially outward from a bottom surface of the flow passage spatial portion formed by the stepped portion and the labyrinth-shaped recess to be in the range of a height of ½ to ¾ as high as the flow passage spatial portion.

* * * * *